US011404757B2

(12) United States Patent
Baum

(10) Patent No.: US 11,404,757 B2
(45) **Date of Patent: *Aug. 2, 2022**

(54) MULTI-BAND RF MONOBLOCK FILTER CONFIGURED TO HAVE AN ANTENNA INPUT/OUTPUT LOCATED FOR SEPARATING FIRST AND SECOND FILTERS FROM A THIRD FILTER

(71) Applicant: CTS Corporation, Lisle, IL (US)

(72) Inventor: Fred W. Baum, Tijeras, NM (US)

(73) Assignee: CTS CORPORATION, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/900,877

(22) Filed: Jun. 13, 2020

(65) Prior Publication Data

US 2020/0313266 A1 Oct. 1, 2020

Related U.S. Application Data

(63) Continuation of application No. 16/029,793, filed on Jul. 9, 2018, now Pat. No. 10,686,238, and a (Continued)

(51) Int. Cl.
*H01P 1/213* (2006.01)
*H01P 1/205* (2006.01)
(Continued)

(52) U.S. Cl.
CPC ..... *H01P 1/2136* (2013.01); *H01P 1/2002* (2013.01); *H01P 1/2056* (2013.01); *H01P 3/08* (2013.01); *H01P 7/06* (2013.01)

(58) Field of Classification Search
CPC ..... H01P 1/2056; H01P 1/2136
(Continued)

(56) References Cited

U.S. PATENT DOCUMENTS 4,431,977 A 2/1984 Sokola et al.
5,045,824 A 9/1991 Metroka
(Continued)

FOREIGN PATENT DOCUMENTS

CN 1768445 A 5/2006
JP 57109838 A 7/1982
(Continued)

OTHER PUBLICATIONS

You et al., Single-Block Ceramic Microwave Bandpass Filters, Microwave Journal, Nov. 1994.
(Continued)

*Primary Examiner* — Benny T Lee
(74) *Attorney, Agent, or Firm* — Michael Best & Friedrich LLP

(57) ABSTRACT

A multi-band RF monoblock filter including at least three RF signal filters defined in the monoblock of dielectric material by resonators defined in part by through-holes extending through the block. In one embodiment, two of the RF signal filters are in a co-linear and side-by-side relationship and the third filter is in a parallel and side-by side relationship with one of the two other RF signal filters. A pattern of conductive material defines two end and one interior RF signal input/output on the block top surface. The end RF signal input/outputs are located at opposite ends of the block and the central RF signal input/output is located between the two co-linear and side-by-side RF filters. An RF signal is transmitted through the one end RF signal input/output, the two parallel and side-by-side RF signal filters, and the central RF signal input/output and also through the other end RF signal input/output, one of the co-linear and side-by-side RF filters, and the central RF signal input/output.

12 Claims, 3 Drawing Sheets

Related U.S. Application Data continuation of application No. 15/182,795, filed on Jun. 15, 2016, now Pat. No. 10,027,007.

(51) Int. Cl.

| | |
|---|---|
| ***H01P 1/20*** | (2006.01) |
| ***H01P 3/08*** | (2006.01) |
| ***H01P 7/06*** | (2006.01) |

(58) Field of Classification Search

USPC ..... 333/206, 134

See application file for complete search history.

(56) References Cited

U.S. PATENT DOCUMENTS

| | | | |
|---|---|---|---|
| 5,191,305 | A | 3/1993 | Frost et al. |
| 5,202,654 | A | 4/1993 | Heine |
| 5,712,604 | A | 1/1998 | Tada et al. |
| 5,731,746 | A | 3/1998 | Sokola et al. |
| 5,986,521 | A | 11/1999 | Tada et al. |
| 6,559,735 | B1 | 5/2003 | Hoang et al. |
| 6,809,612 | B2 | 10/2004 | Bloom et al. |
| 6,853,271 | B2 | 2/2005 | Wilber et al. |
| 6,879,222 | B2 | 4/2005 | Vangala et al. |
| 7,075,388 | B2 | 7/2006 | Rogozine et al. |
| 7,321,278 | B2 | 1/2008 | Vangala |
| 7,541,893 | B2 | 6/2009 | Ye |
| 7,619,496 | B2 | 11/2009 | Rogozine |
| 7,928,816 | B2 | 4/2011 | Vangala |
| 8,174,340 | B2 | 5/2012 | Vangala |
| 8,261,714 | B2 | 9/2012 | Nummerdor |
| 8,283,108 | B2 | 10/2012 | Chiu et al. |
| 10,027,007 | B2 | 7/2018 | Baum |
| 10,686,238 | B2 * | 6/2020 | Baum ..... H01P 7/06 |
| 2015/0295294 | A1 | 10/2015 | Rogozine |

FOREIGN PATENT DOCUMENTS

| | | | |
|---|---|---|---|
| WO | 2001052344 | A1 | 7/2001 |
| WO | 2004/093239 | A1 | 10/2004 |

OTHER PUBLICATIONS

Spectrum Microwave, Inc., RF & Microwave Components and Systems, http://www.mouser.com/ds/2/382/rf_microwavecat-204398.pdf 2016.

Lin, New Designs of Bandpass Filters, IEEE Transactions on Microwave Theory and Techniques, Dec. 2010, vol. 58, No. 12, IEEE.

* cited by examiner

MULTI-BAND RF MONOBLOCK FILTER CONFIGURED TO HAVE AN ANTENNA INPUT/OUTPUT LOCATED FOR SEPARATING FIRST AND SECOND FILTERS FROM A THIRD FILTER

CROSS-REFERENCE TO RELATED APPLICATIONS

This application is a continuation application which claims the benefit of the filing date and disclosure of U.S. patent application Ser. No. 16/029,793 filed on Jul. 9, 2018, now U.S. Pat. No. 10,686,238 issued on Jun. 16, 2020 which is a continuation of U.S. patent application Ser. No. 15/182,795 filed on Jun. 15, 2016, now U.S. Pat. No. 10,027,007 issued on Jul. 17, 2018 which claimed the benefit of the filing date and disclosure of U.S. Provisional Patent Application Ser. No. 62/181,026 filed on Jun. 17, 2015, the contents of all of these patent applications being incorporated herein by reference as are all references cited therein.

TECHNICAL FIELD

This invention relates to an RF dielectric monoblock filter and, in particular, to a multi-band RF dielectric monoblock filter.

BACKGROUND OF THE INVENTION

Ceramic dielectric block filters offer several advantages over lumped component filters. The blocks are relatively easy to manufacture, rugged, and relatively compact. In the basic ceramic block filter design, the resonators are formed by typically cylindrical passages, called through-holes, extending through the block from the long narrow side to the opposite long narrow side. The block is substantially plated with a conductive material (i.e. metallized) on all but one of its six (outer) sides and on the inside walls formed by the resonator through-holes.

One of the two opposing sides containing through-hole openings is not fully metallized, but instead bears a metallization pattern designed to couple input and output signals through the series of resonators. This patterned side is conventionally labeled as the top of the block. In some designs, the pattern may extend to sides of the block, where input/output electrodes are formed.

The reactive coupling between adjacent resonators is dictated, at least to some extent, by the physical dimensions of each resonator, by the orientation of each resonator with respect to the other resonators, and by aspects of the top surface metallization pattern. Interactions of the electromagnetic fields within and around the block are complex and difficult to predict.

These filters may also be equipped with an external metallic shield attached to and positioned across the open-circuited end of the block in order to cancel parasitic coupling between non-adjacent resonators and to achieve acceptable stopbands.

Although such RF signal filters have received widespread commercial acceptance since the 1980s, efforts at improvement on this basic design continued.

In the interest of allowing wireless communication providers to provide additional service, governments worldwide have allocated new higher RF frequencies for commercial use. To better exploit these newly allocated frequencies, standard setting organizations have adopted bandwidth specifications with compressed transmit and receive bands as well as individual channels. These trends are pushing the limits of filter technology to provide sufficient frequency selectivity and band isolation.

Coupled with the higher frequencies and crowded channels are the consumer market trends towards ever smaller wireless communication devices and longer battery life. Combined, these trends place difficult constraints on the design of wireless components such as filters. Filter designers may not simply add more space-taking resonators or allow greater insertion loss in order to provide improved signal rejection.

There is a need for an RF dielectric monoblock filter in which three or more frequency bands can be filtered using a single monoblock and only three RF signal input/output ports.

SUMMARY OF THE INVENTION

The present invention is directed to a multi-band RF dielectric monoblock filter for the transmission of an RF signal comprising a block of dielectric material including top, bottom, and side surfaces; at least first, second, and third sets of through-holes defining at least first, second, and third sets of resonators and at least first, second, and third RF signal transmission filters, each of the through-holes defining an interior surface and extending through the block of dielectric material and terminating in respective openings in the top and bottom surfaces of the block of dielectric material; a pattern of conductive material on the top, bottom, and side surfaces of the block of dielectric material and the interior surface of the through-holes including respective regions of conductive material on the top surface surrounding the respective openings defined by the at least first, second, and third sets of through-holes respectively; the pattern of conductive material including first, second, and third strips of conductive material defining first, second, and third RF signal input/output transmission lines, the first and second RF signal input/output transmission lines being located at opposite ends of the first and second RF signal transmission filters for the transmission of the RF signal through the first RF signal input/output transmission line, the first and second filters, and the second RF signal input/output transmission line, the second and third RF signal input/output transmission lines being located at opposite ends of the third RF signal transmission filter for the transmission of the RF signal through the second RF signal input/output transmission line, the third RF signal filter, and the third RF signal input/output transmission line.

In one embodiment, the first and third RF signal transmission filters are adapted for the transmission of Tx and Rx signals respectively, the second RF signal transmission filter being adapted for the transmission of Tx or Rx signals respectively.

In one embodiment, the first and third RF signal transmission filters are oriented in a co-linear and side-by-side relationship relative to each other and the first and second RF signal transmission filters are oriented in a parallel and side-by-side relationship relative to each other.

In one embodiment, the first and second RF signal transmission filters are separated by an elongate slot extending in a relationship spaced and parallel to the first and second RF signal transmission filters.

The present invention is also directed to a multi-band RF dielectric monoblock filter for the transmission of an RF signal comprising a block of dielectric material including top, bottom, and side surfaces with a pattern of conductive material; at least first, second, and third RF signal filters defined in the block of dielectric material, each of the at least first, second, and third RF signal filters comprising a plurality of through-holes and the pattern of conductive material in combination defining a plurality of resonators, each of the through-holes extending through the interior of the block of dielectric material and terminating in respective openings in the top and bottom surfaces of the block of dielectric material; the first and third RF signal filters being oriented in a co-linear and side-by-side relationship relative to each other and the first and second RF signal filters being oriented in a parallel and side-by side relationship relative to each other; and the first, second, and third RF signal input/output transmission lines defined on the top surface of the block of dielectric material by the pattern of conductive material, the first and second RF signal input/output transmission lines being located on opposite sides of the first and second RF signal filters for the transmission of the RF signal through the first RF signal input/output transmission line, the first and second filters, and the second RF signal input/output transmission line and the second and third RF signal input/output transmission lines being located on opposite sides of the third RF signal filter for the transmission of the RF signal through the second RF signal input/output transmission line, the third RF signal filter, and the third RF signal input/output transmission line.

In one embodiment, the first and third RF signal transmission filters are adapted for the transmission of Tx and Rx signals respectively, the second RF signal transmission filter being adapted for the transmission of Tx or Rx signals respectively.

In one embodiment, the first and second RF signal transmission filters are separated by an elongate slot extending in a relationship spaced and parallel to the first and second RF signal transmission filters.

The present invention is further directed to a multi-band RF dielectric monoblock filter comprising a block of dielectric material including top, bottom, and side surfaces; at least three RF signal filters defined in the monoblock of dielectric material by resonators defined in part by through-holes extending through the block; two of the RF signal filters extending in a co-linear and side-by-side relationship and the other filter being oriented in a parallel and side-by side relationship with one of the two other RF signal filters; and a pattern of conductive material on the top surface defines a pair of end and one interior RF signal input/output transmission line, the end RF signal input/output transmission lines are located at opposite ends of the block and the central RF signal input/output is located between the two co-linear and side-by-side RF filters for the transmission of the RF signal through the one end RF signal input/output transmission line, the two parallel and side-by-side RF signal filters, and the central RF signal input/output transmission line and also through the other end RF signal input/output transmission line, one of the co-linear and side-by-side RF filters, and the central RF signal input/output transmission line.

In one embodiment, two of the RF signal filters are separated by an elongate slot extending in a relationship spaced and parallel to the first and second RF signal transmission filters.

There are other advantages and features of this invention, which will be more readily apparent from the following detailed description of the embodiments of the invention, the drawings, and the appended claims.

BRIEF DESCRIPTION OF THE FIGURES

In the accompanying drawings that form part of the specification, and in which like numerals are employed to designate like parts throughout the same.

DETAILED DESCRIPTION OF THE EMBODIMENT

Figure 1:
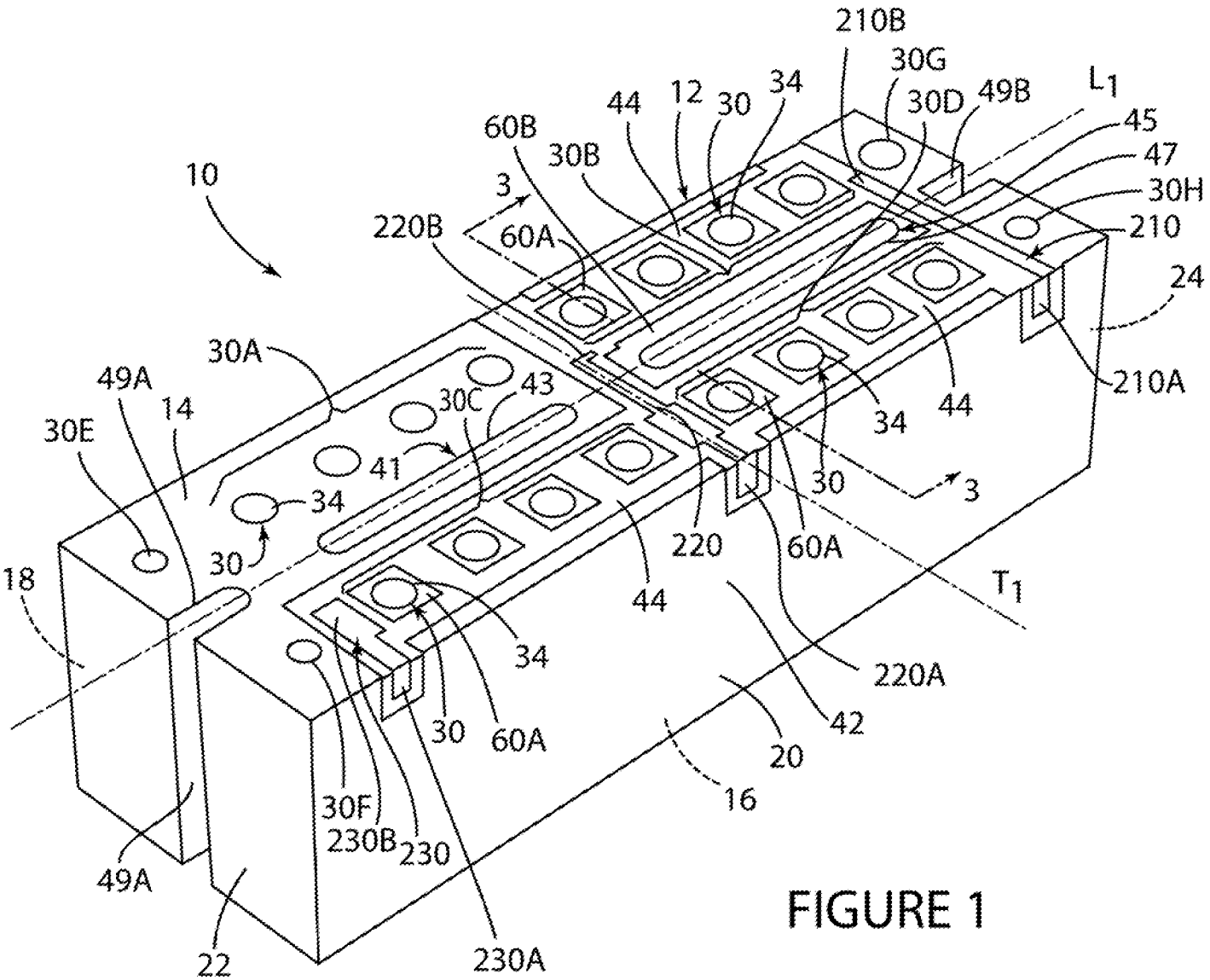
FIG. 1 is an enlarged perspective view of a multi-band RF dielectric monoblock filter in accordance with the present invention.
Figure 2:
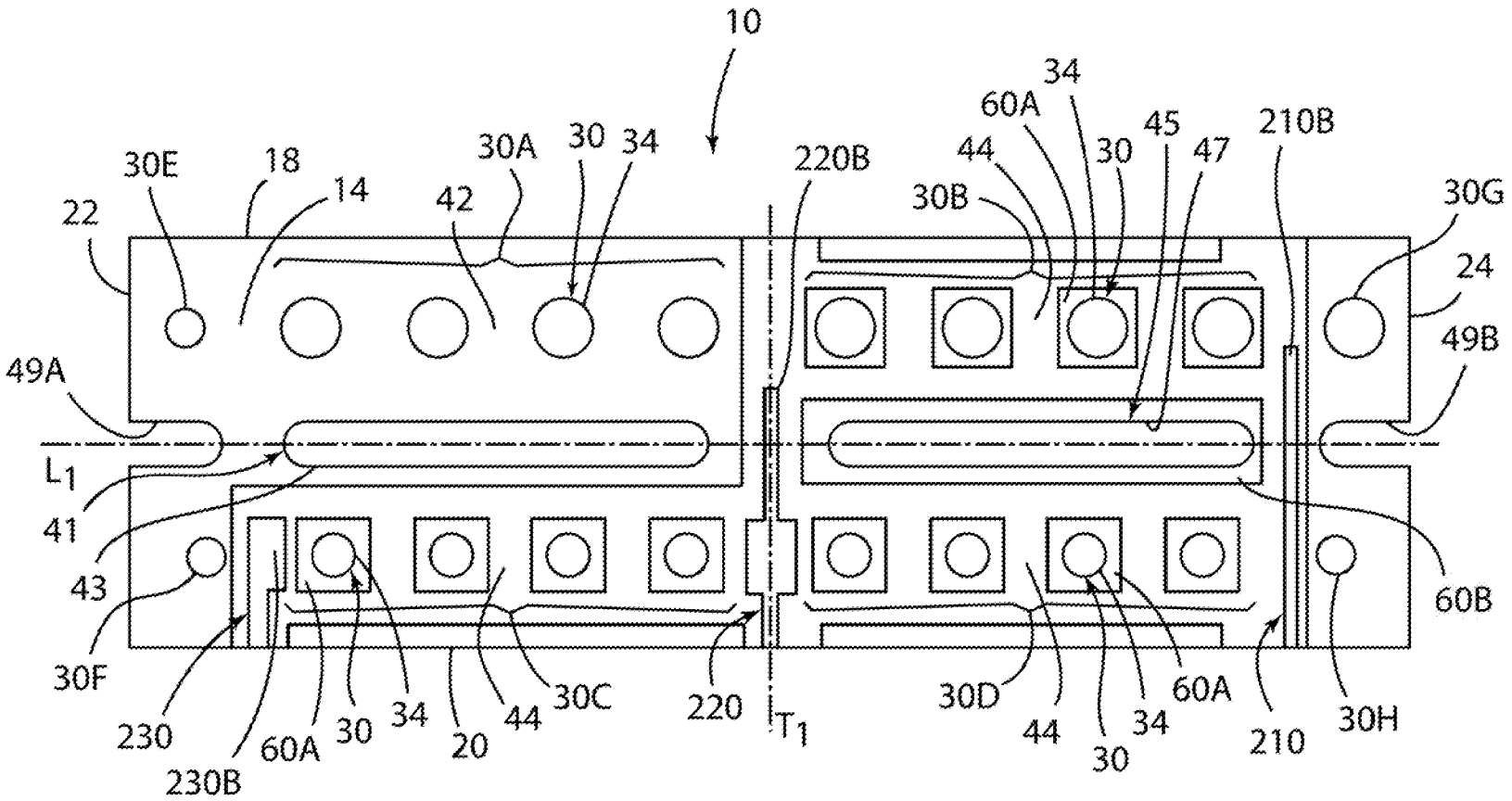
FIG. 2 is an enlarged top plan view of the multi-band RF dielectric monoblock filter in accordance with the present invention.
Figure 3:
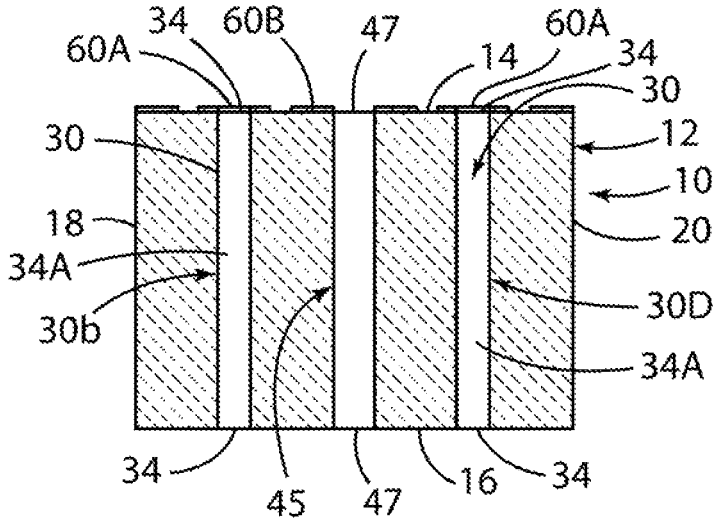
FIG. 3 is a vertical cross-sectional view of the multi-band RF dielectric monoblock filter taken along the line 3-3 in FIG. 1.

FIGS. 1, 2, and 3 depict a multi-band RF dielectric monoblock filter 10 in accordance with the present invention which, in the embodiment shown, comprises a generally elongate, parallelepiped or rectangular box-shaped rigid and solid block or core 12 (FIGS. 1 and 2) comprised and made of a ceramic dielectric material with a predetermined and desired dielectric constant.

In one embodiment, the dielectric material can be an alumina, barium or neodymium ceramic with a dielectric constant of about 11 or above. Core 12 defines an outer or exterior surface with six generally rectangular sides: a longitudinally extending top exterior surface 14; a longitudinally extending bottom exterior surface 16 (FIGS. 1 and 3) that is parallel to and diametrically opposed from the top exterior surface 14; a longitudinally extending first exterior side surface 18; a longitudinally extending second exterior side surface 20 that is parallel to and diametrically opposed from the first exterior side surface 18; a transversely extending third exterior side or end surface 22 (FIGS. 1 and 2); and a transversely extending fourth side or end surface 24 (FIGS. 1 and 2) that is parallel to and diametrically opposed from the third exterior side or end surface 22.

The filter 10 has a plurality of resonators defined in part by a plurality of through-holes 30 defined in the core 12 of the filter 10 and, more specifically, a plurality of through-holes 30 which each extend through the interior of the core 12 in a relationship normal to and terminating in respective openings 34 in the top and bottom filter surfaces 14 and 16 as shown in FIG. 3. Each of the through-holes 30 is defined by an inner cylindrical metallized side-wall surface 34A (FIG. 3).

In the embodiment shown, the filter 10 includes four sets or groups 30A (FIGS. 1 and 2), 30B, 30C (FIGS. 1 and 2), and 30D of through-holes 30, i.e., two co-linear and spaced apart sets 30A and 30B of through-holes 30 extending in a spaced apart and co-linear relationship relative to each other and further in a relationship adjacent and spaced from and parallel to the filter exterior side surface 18 and the filter/block longitudinal axis L1 (FIGS. 1 and 2); and two additional co-linear and spaced apart sets 30C and 30D of through-holes 30 extending in a spaced apart and co-linear relationship relative to each other and further in a relationship adjacent and spaced from and parallel to the opposed filter exterior side surface 20 and the filter/block longitudinal axis L1. It is understood that in the interest of clarity and simplification in FIGS. 1, 2, and 3, only one of the four through-holes 30 in each of the sets 30A, 30B, 30C, and 30D has been designated with the numeral 30.

In the embodiment shown, the sets 30A and 30C of through-holes 30 are located on the filter 10 relative to each other in a diametrically opposed and spaced apart relationship on opposite sides of and spaced from and parallel to both the longitudinal central axis L1 of the filter 10 and a first elongated and generally oval shaped slot 41 that extends through the interior of the core 12 of the filter 10 in a relationship co-linear and intersecting the filter/block longitudinal axis L1 and terminating in respective openings 43 in the respective top and bottom exterior surfaces 14 and 16 of the filter 10. Thus, in the embodiment shown, the slot 41 extends the length of each of the sets 30A and 30C of through-holes 30 and separates and isolates the respective sets 30A and 30C of through-holes 30 from each other and more specifically separates and isolates the set 30C from the set 30A of through-holes 30.

Further, in the embodiment shown, the sets 30B and 30D of through-holes 30 are located on the filter 10 relative to each other in a diametrically opposed and spaced apart relationship on opposite sides of and spaced from and parallel to both the longitudinal axis $L_1$ of the filter 10 and a second elongated and generally oval shaped slot 45 that extends through the interior of the core 12 of the filter 10 in a relationship co-linear with and intersecting the filter/block longitudinal axis $L_1$ and terminating in respective openings 47 in the respective top and bottom exterior surfaces 14 and 16 of the filter 10. Thus, in the embodiment shown, the slot 45 extends the length of each of the sets 30B and 30C of through-holes 30 and separates and isolates the respective RF filters 30B and 30D from each other.

Further, in the embodiment shown, the respective sets 30A and 30C and 30B and 30D of through-holes 30 are located relative to each other in a diametrically opposed and spaced apart relationship on opposite sides of and spaced from the central filter/block transverse axis T1 (FIGS. 1 and 2) of the filter 10 with the set 30A of through-holes 30 diametrically opposed to and co-linear with the set 30B of through-holes 30 and the set 30C of through-holes 30 diametrically opposed and co-linear with the set 30D of through-holes 30. Further, in the embodiment shown, each of the sets 30A, 30B, 30C, and 30D of through-holes 30 comprises four through-holes 30 although it is understood that each of the sets 30A, 30B, 30C, and 30D of through-holes 30 could include less than or greater than four through-holes 30 depending upon the particular application.

Still further, in the embodiment shown in FIGS. 1 and 2, the filter 10 includes four additional end through-holes 30E, 30F, 30G, and 30H that define shunt zeros. The two through-holes 30E and 30F are located in the filter 10 between the end exterior surface 22 and the sets of through-holes 30A and 30C respectively and, more specifically, are located at one end of the block 12 and positioned in a relationship spaced and co-linear with the respective sets 30A and 30C of through-holes 30. The other two through-holes 30G and 30H are located at the other end of the block 12 in a relationship diametrically opposed to the end through-holes 30E and 30F and, more specifically, are located in the filter 10 between the opposed exterior end surface 24 and the sets 30B and 30D of through-holes 30 and, still more specifically, are positioned in a relationship spaced and co-linear with the respective sets 30B and 30D of through-holes 30.

Moreover, in the embodiment shown, the through-holes 30E and 30F are located adjacent the exterior end surface 22 on opposite sides of and spaced from both the longitudinal axis L1 (FIGS. 1 and 2) of the filter 10 and on opposite sides of and spaced from an elongated groove 49A (FIGS. 1 and 2) that is defined in the exterior end surface 22 of the filter 10 and extends in a relationship co-linear with and intersecting the filter/block longitudinal axis L1 and separating and isolating the respective through-holes 30E and 30F.

In a like manner, the through-holes 30G and 30H are located adjacent the exterior end surface 24 on opposite sides of and spaced from both the longitudinal axis L1 (FIGS. 1 and 2) of the filter 10 and on opposite sides of and spaced from an elongated groove 49B (FIGS. 1 and 2) that is defined in the side surface 20 of the filter 10 and extends in a relationship co-linear with and intersecting the filter/block longitudinal axis L1 of the filter 10 and separating and isolating the respective through-holes 30G and 30H.

In the embodiment shown, the through-holes 30 in each of the sets 30A and 30B of through-holes 30 and the through-hole 30G are all of the same diameter that is larger than the through-holes 30 in each of the sets 30C and 30D of through-holes 30 and the through-holes 30E, 30F, and 30H which all have the same diameter.

The top exterior surface 14 of core 12 additionally defines a surface-layer pattern of electrically conductive metallized and insulative unmetallized areas or patterns. The metallized areas are preferably a surface layer of conductive silver-containing material.

The pattern also defines a wide area or pattern of metallization 42 that covers at least the bottom exterior surface 16, the side exterior surfaces 18 and 20, the end exterior surfaces 22 and 24, the interior cylindrical surface of the through-holes 30, the interior surface of the slots 41 and 45, and the interior surface of the grooves 49A and 49B. Metallized area 42 extends contiguously from within resonator through-holes 30, the slots 41 and 45, and the grooves 49A and 49B towards both the top exterior surface 14 and the bottom exterior surface 16. Metallization area 42 may also be labeled a ground electrode. Metallized area 42 serves to absorb or prevent transmission of off-band signals.

In the embodiment shown, a portion of metallized area on the top surface 14 is present in the form of respective resonator pads 60A that surround each of the openings 34 defined in the top surface 14 by each of the respective through-holes 30 of each of the sets 30A, 30B, and 30D of through-holes 30 and a pad 60B that surrounds the slot 45 and is spaced from the pads 60A. Resonator pads 60A are contiguous or connected with metallization area 42 on the side exterior surfaces 18, 20, 22, and 24. Resonator pads 60A are shaped to have predetermined capacitive couplings to adjacent resonators and other areas of surface-layer metallization.

An unmetallized area or pattern 44 extends over portions of the top exterior surface 14. Unmetallized area 44 surrounds all of the metallized resonator pads 60A, the pad 60B, each of the openings 34 of the through-holes 30 defining the set 30A of through-holes 30, and each of the additional transmission zero through-holes 30E, 30F, 30G, and 30H.

As shown in FIGS. 1 and 2, the surface-layer pattern additionally defines three isolated metallized RF signal input/output areas or strip transmission lines, or electrodes 210, 220, and 230 that are formed on the top exterior surface 14, extend in a relationship normal to the respective sets 30A, 30B, 30C, and 30D of through-holes 30 and the filter longitudinal axis L1, and terminate at one end in respective RF signal input/output pads 210A, 220A, and 230A formed in the side exterior surface 20.

End electrode 210 is in the form of an elongated straight strip of metallization that is located and formed on the top exterior surface 14 of the core 12 of the filter 10 and extends in a relationship parallel to and adjacent the exterior end surface 24 of the filter 10 and further in a relationship normal to and intersecting the filter/block longitudinal axis $L_1$. Electrode 210 is located at one end of the block 12 between and in a relationship spaced from the end through-holes 30G and 30H and the sets 30B and 30D of through-holes 30 and extends from the side exterior surface 20 in the direction of the opposed side exterior surface 18 and terminates in an end tip 210B on the top exterior surface 14 that is located in a relationship short and spaced from the opposed side exterior surface 18 and that is adjacent and spaced from the end through-hole 30 of the set 30B of through-holes 30.

Center electrode 220 is in the form of an elongated straight strip of metallization that is centrally located and formed on the top exterior surface 14 of the core 12 of the filter 10 and extends in a relationship co-linear with the central transverse axis $T_1$ of the filter 10. Electrode 220 is located and extends between and spaced from the sets 30A and 30C of through-holes 30 and the sets 30B and 30D of through-holes 30 and extends from the side exterior surface 18 in the direction of the opposed side exterior surface 20 and terminates in an end tip 220B on the top exterior surface 14 that is located in a relationship short and spaced from the opposed side surface 18 and that is adjacent and spaced from the end through-hole 30 of the sets 30A and 30B of through-holes 30.

End electrode 230 is in the form of an elongated straight strip of metallization that is located and formed on the top exterior surface 14 of the core 12 of the filter 10 and extends in a relationship parallel to and adjacent the side exterior surface 22 of the filter 10 and further in a relationship normal to the filter longitudinal axis $L_1$. Electrode 230 is located at the end of the block 12 between and in a relationship spaced from the end through-holes 30E and 30F and the sets of through-holes 30A and 30C and extends from the side exterior surface 20 in the direction of the opposed side exterior surface 18 and terminates in an end tip 230B on the top exterior surface 14 that is located in a relationship short and spaced from the opposed side exterior surface 18 and that is adjacent and spaced from the end through-hole 30 of the set 30C of through-holes 30.

Thus, in the embodiment shown, the respective electrodes 210 and 220 define respective common input/output transmission lines for the RF signal transmitted through the respective sets 30B and 30D of through-holes 30 and the electrode 230 defines an input/output transmission line for the RF signal transmitted through the set 30C of through-holes 30.

Thus, for example, in an embodiment of the filter 10 wherein the center electrode 220 is an antenna input/output electrode, the electrode 210 defines a Tx signal input/output electrode and the electrode 230 defines an Rx signal input/output electrode, the Tx signal is inputted into and through the electrode 210, transmitted through the resonators defined by each of the sets 30B and 30D of through-holes 30, and then outputted through the antenna electrode 220. The Rx signal is inputted into and through the antenna electrode 220, transmitted through the resonators defined by the first set 30A of through-holes 30, and then outputted through the Rx input/output electrode 230.

Thus, in the embodiment as described above, the sets 30D and 30C of through-holes 30 define the Tx and Rx signal filters respectively of an RF signal dielectric monoblock duplexer filter while the set 30B of through-holes 30 define a separate Tx signal bandpass filter.

Still more specifically, in the embodiment shown, the pair of Tx filters defined by the sets 30B and 30D of through-holes 30 allow for the filtering and separation of two different bands of Tx signals in a single monoblock structure. It is understood of course that the function of the electrodes 210 and 230 could be reversed to define Rx and Tx signal input/output electrodes respectively such that the sets 30B and 30D of through-holes define respective Rx signal filters portions adapted to filter and separate two different bands of Rx signals in a single monoblock structure.

Further, it is understood that in the embodiment shown, the through-holes 30 in the set 30A of through-holes 30 are all coupled to ground and the filter 10 is thus adapted and designed as a multi-band, namely three band, RF dielectric monoblock filter 10. In an alternate embodiment, the set 30D of through-holes 30 could be designed with resonator pads similar in structure to the resonator pads 60A and with an input/output electrode 230 extending and terminating in a tip located adjacent the end through-hole 30 of the set 30A of through-holes 30 to allow the filter 10 to operate as a multi-band, namely four band, RF dielectric monoblock filter 10.

Figure 4:
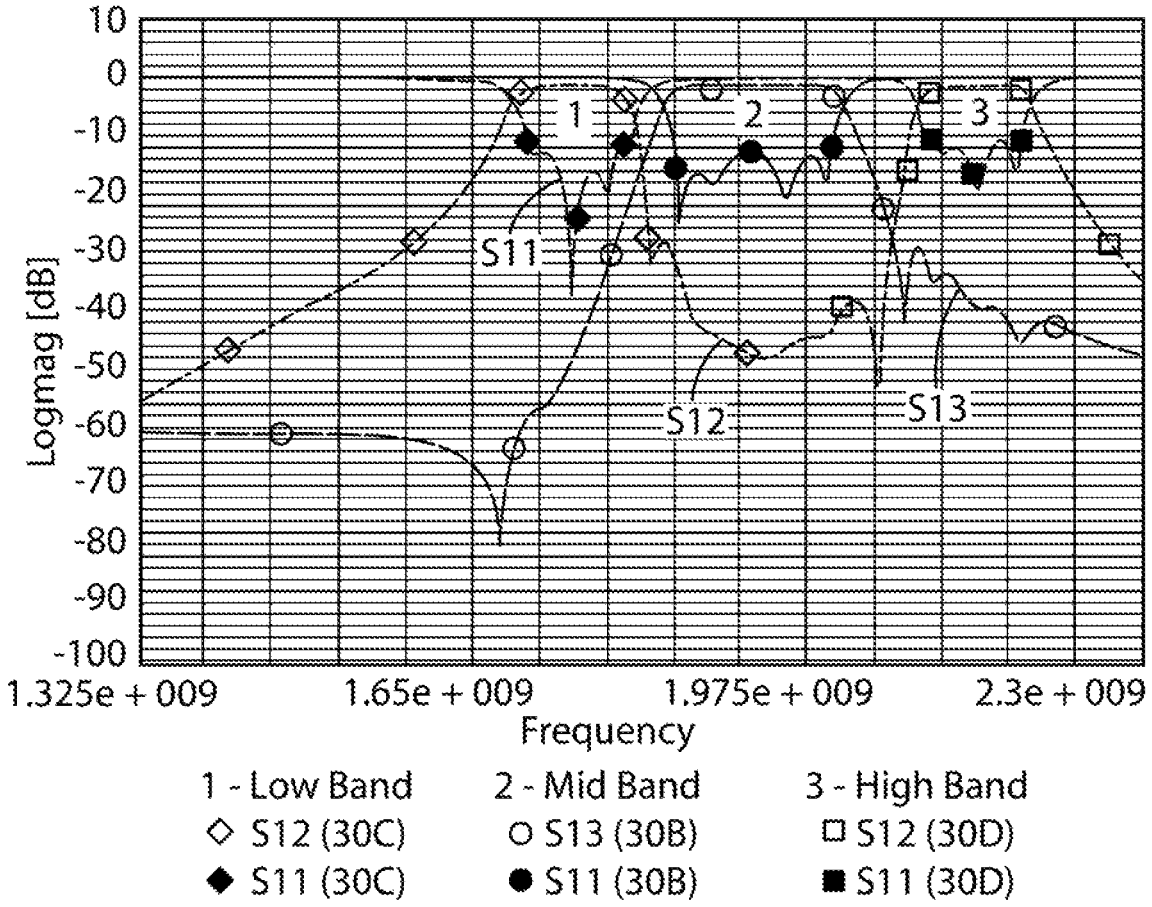
FIG. 4 is a graph depicting the performance of the multi-band RF dielectric monoblock filter shown in FIG. 1.

FIG. 4 is a graph of RF Log mag [db] v. RF signal frequency in which the three lines S11, S12, and S13 exhibit and represent the low band, mid band, and high band performance characteristics of the band 30B (i.e. mid band 2), 30C (i.e., low band 1), and 30D (i.e. high band 3) of the multi-band RF dielectric monoblock filter 10 of the present invention.

Numerous variations and modifications of the multi-band RF monoblock filter described above may be effected without departing from the spirit and scope of the novel features of the invention.

For example, it is understood that the through-holes 30 in each of the sets 30A, 30B, 30C, and 30D of through-holes 30 can be positioned relative to each other in a non-linear or staggered relationship relative to each other and that the filter 10 could include additional sets of through-holes adapted to define additional bandpass filters depending of course on the particular application and purpose of the filter 10.

It is also to be understood that no limitations with respect to the embodiment illustrated herein are intended or should be inferred. It is, of course, intended to cover by the appended claims all such modifications as fall within the scope of the claims.

I claim:

1. An RF dielectric monoblock filter for the transmission of an RF signal comprising:

a block of dielectric material including top, bottom, and side exterior surfaces including opposed longitudinal side exterior surfaces;

a plurality of resonators defining a plurality of RF signal filters including a first pair of RF signal filters located on the block of dielectric material between the first and second opposed longitudinal side exterior surfaces in a parallel and spaced relationship relative to each other and the first and second opposed longitudinal side exterior surfaces, and a third RF signal filter located on the block of dielectric material in a side-by-side and spaced relationship relative to the first pair of RF signal filters; and at least first, second, and third RF signal input/outputs for the transmission of the RF signal through the plurality of RF signal filters, the first and third RF signal input/outputs comprising Tx or Rx RF signal input/outputs at opposed ends of the block of dielectric material and the second RF signal input/output comprising an antenna RF signal input/output located between the first and third RF signal input/outputs, the first pair of RF signal filters located between the first and second RF signal input/outputs and the third RF signal filter located between the second and third RF signal input/outputs, the RF signal being transmitted between the first and second RF signal input/outputs and through the first pair of RF signal filters and between the second and third RF signal input/outputs and through the third RF signal filter.

2. The RF dielectric monoblock filter of claim 1, wherein the first pair of RF signal filters are separated by an elongate slot in the block of dielectric material that extends in a relationship spaced and parallel to the first pair of RF signal filters and the opposed longitudinal side exterior surfaces.

3. The RF dielectric monoblock filter of claim 1, wherein the plurality of resonators are defined by a plurality of spaced-apart through-holes extending through and terminating in a plurality of apertures defined in the top and bottom exterior surfaces of the block of dielectric material.

4. The RF dielectric monoblock filter of claim 1, wherein the third RF signal filter extends in a relationship co-linear with one of the RF signal filters of the first pair of RF signal filters.

5. An RF dielectric monoblock filter for the transmission of an RF signal comprising:

a block of dielectric material including top, bottom, and side exterior surfaces including opposed longitudinal side exterior surfaces;

a plurality of resonators defining at least first, second, and third RF signal filters; and a plurality of RF signal input/outputs, for the transmission of the RF signal through the first, second, and third RF signal filters, including a first antenna RF signal input/output positioned on the block of dielectric material in a relationship with at least the first and second RF signal filters located on one side of the first antenna RF signal input/output and the third RF signal filter located on an opposed side of the first antenna RF signal input/output.

6. The RF dielectric monoblock filter of claim 5, wherein the third RF signal filter extends in a relationship co-linear with the first RF signal filter.

7. The RF dielectric monoblock filter of claim 5, wherein the first, second, and third RF signal filters are defined by respective sets of spaced-apart through-holes extending through and terminating in a plurality of apertures defined in the top and bottom exterior surfaces of the block of dielectric material.

8. The RF dielectric monoblock filter of claim 7, comprising second and third RF signal input/outputs at opposed ends of the block of dielectric material.

9. The RF dielectric monoblock filter of claim 5, wherein the first and second RF signal filters are positioned in a parallel relationship and separated by an elongate slot defined in the block of dielectric material.

10. An RF dielectric monoblock filter for the transmission of an RF signal comprising:

a block of dielectric material including top, bottom, and side exterior surfaces including opposed longitudinal side exterior surfaces;

a plurality of resonators defining at least first, second, and third RF signal filters;

an elongate slot between the first and second RF signal filters; and a plurality of RF signal input/outputs, for the transmission of the RF signal through the first, second, and third RF signal filters, including first, second, and third RF signal input/outputs, the first and third RF signal input/outputs being located at opposed ends of the block of dielectric material and comprising Tx or Rx RF signal input/outputs and the second RF signal input/output comprising an antenna RF signal input/output located between the first and third RF signal input/outputs, the first and second RF signal filters being located between the first and second RF signal input/outputs and the third RF signal filter being located between the second and third RF signal input/outputs.

11. The RF dielectric monoblock filter of claim 10, wherein the first and second RF signal filters are positioned in a parallel and spaced relationship relative to each other and the elongate slot, the third RF signal filter positioned in a side-by-side and spaced relationship relative to the first and second RF signal filters.

12. The RF dielectric monoblock filter of claim 10, wherein the first, second, and third RF signal filters are defined by respective sets of spaced-apart through-holes extending through and terminating in a plurality of apertures defined in the top and bottom exterior surfaces of the block of dielectric material.

* * * * *